US010001354B2

(12) United States Patent
Kalliala

(10) Patent No.: US 10,001,354 B2
(45) Date of Patent: Jun. 19, 2018

(54) MUNITION

(71) Applicant: Leijona Instituutti Oy, Espoo (FI)

(72) Inventor: Juho Kalliala, Helsinki (FI)

(73) Assignee: LEIJONA INSTITUUTI OY, Espoo (FI)

( * ) Notice: Subject to any disclaimer, the term of this patent is extended or adjusted under 35 U.S.C. 154(b) by 142 days.

(21) Appl. No.: 15/026,994

(22) PCT Filed: Oct. 2, 2013

(86) PCT No.: PCT/FI2013/050951
§ 371 (c)(1),
(2) Date: Apr. 4, 2016

(87) PCT Pub. No.: WO2015/049411
PCT Pub. Date: Apr. 9, 2015

(65) Prior Publication Data

US 2016/0258729 A1 Sep. 8, 2016

(51) Int. Cl.

| | |
|---|---|
| ***F42B 12/32*** | (2006.01) |
| ***F42B 12/58*** | (2006.01) |
| ***F42B 12/20*** | (2006.01) |
| ***F42B 12/22*** | (2006.01) |

(52) U.S. Cl.
CPC ..... *F42B 12/58* (2013.01); *F42B 12/202* (2013.01); *F42B 12/207* (2013.01); *F42B 12/22* (2013.01)

(58) Field of Classification Search
CPC ..... F42B 12/22; F42B 12/32
USPC ..... 102/475, 476, 389, 492, 493, 494, 496, 102/497
See application file for complete search history.

(56) References Cited

U.S. PATENT DOCUMENTS

| | | | | |
|---|---|---|---|---|
| 2,972,949 | A | 2/1961 | MacLeod | |
| 3,750,587 | A | 8/1973 | Walde | |
| 3,818,833 | A | 6/1974 | Throner | |
| 6,619,210 | B1 * | 9/2003 | Spivak | F42B 12/10 102/475 |

FOREIGN PATENT DOCUMENTS

| | | | |
|---|---|---|---|
| DE | 2340652 | A1 | 4/1974 |
| DE | 3900442 | A1 | 7/1990 |
| DE | 4002409 | A1 | 8/1991 |
| DE | 102010045516 | A1 | 3/2012 |
| FR | 2520862 | A1 | 8/1983 |
| GB | 2142418 | A | 1/1985 |
| GB | 2142419 | A | 1/1985 |
| GB | 2275322 | A | 8/1994 |
| SE | 341361 | B | 12/1971 |

OTHER PUBLICATIONS

Japan Patent Office, Office Action issued on JP2016-546176, dated Apr. 18, 2017.

* cited by examiner

*Primary Examiner* — Reginald Tillman, Jr.
(74) *Attorney, Agent, or Firm* — Berggren LLP; Sangkyung Lee

(57) ABSTRACT

Described herein is a munition to be exploded in the air at a position above an intended target. The munition includes an explosive, a matrix of fragmentation material, a body part with a convex shaped support element and a detonator. The layered structure of the munition is such that when detonated, a directional explosion code of fragmentation material is formed in a delimited distribution pattern. The munition can be arranged within a takeoff canister with a takeoff charge.

11 Claims, 4 Drawing Sheets

MUNITION

Figure 1:
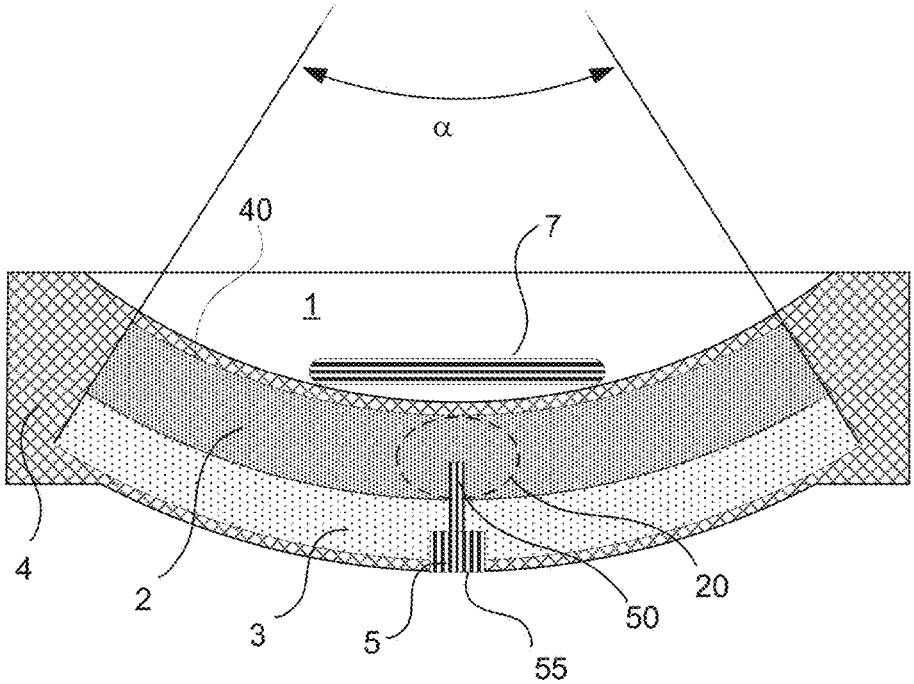

The present invention relates to a munition according to preamble of patent claim 1, especially a munition to be exploded in air at a position above an intended target, the munition comprising:

- an explosive comprising an amount of explosive material,
- a matrix of fragmentation material for causing fragmentation effect to the target,
- a body part to support and hold the parts of the munition together until detonated,
- a detonator for detonating the munition at the given time or position.

In military operations the use of grenades detonated in the air above the intended target and using a proximity detonator has been known and used since the Second World War. For example there are this type of grenades to be launched from a grenade launcher for short distance, artillery grenades to be delivered from intermediate distance and aerial bombs, missiles and rockets for longer distances. Typically these currently contain munition that are detonated with some kind of modern laser or radar sensor equipped detonator. A grenade detonated in the air above the intended target directs the fragmentation material towards the ground mainly because of the grenade structure and the trajectory velocity of the falling down grenade.

For the military purpose there is a constant demand to improve the accuracy of the warfare, to get the effect of the fragmentation material to direct towards the intended target, not to spread around to a random direction. So basically the effectivity of the munition is to be improved and a risk of civil or other surrounding casualties are to be minimized.

From the state of the art it is known the publications GB 2142418A and GB 2142419A disclosing a cluster bomb and a sub-munition for a cluster bomb. The cluster bomb opens up during the flight and diffuses the sub-munition which typically spreads around the ground and after a delay the sub-munitions explode. This type of cluster bomb is problematic since the explosion is uncontrolled, the force of the explosion is spread spherically all over and thus it does not concentrate to the intended target. Furthermore part of the sub-munitions typically remain unexploded on or in the ground and causes possible civil casualties after the war.

The objective of the present invention is to provide a munition that has a predetermined direction of delivering fragmentation material when exploded and has only minor part of fragments spreading around. One further objective is a capability to act as a payload of canister munition of grenades, aerial bombs, rockets and missiles or as a take off canister munition.

The present invention is characterised in that the munition comprises a layered structure so that the body part has a convex shaped support element facing the explosive, the explosive is formed to a shape corresponding the convex shape of the body part and the matrix of fragmentation material is arranged in a convex shape corresponding the shape of the explosive, the detonator is positioned at the apex of the explosive, wherein the layered structure is designed to cause, when detonated, a directional explosion cone of the fragmentation material in order to form a delimited distribution pattern of the fragmentation material over the target area.

The present invention offers an alternative warfare, a munition where the efficiency of the munition is improved such that the most part of the fragmentation material is directed to the intended target and only a minority is lost as spreading around to directions where the fragmentation material is wasted or even harmful. Thus the net weight of fragmentation material hitting the possible targets compared to the gross weight of the whole munition including its carrier is improved.

According to an embodiment of the invention the munition is formed as round, square, quadrangle, hexagonal, parallelogram or corresponding shape in a plane direction and a convex shape in the direction perpendicular to the plane, thus the parts effecting to the explosion cone shape of the munition are formed in a dome shape. Typically the other parts of the munition may follow the shape of the munition and thus for example the explosive can be of the same shape as the munition. The shape of the circumference is one design factor but it can be selected within certain limits on the basis of the selected munition carrier. So for example for artillery launched grenades the circular is the optimal shape and in some other carrier type some other shape is still able to produce quite similar effect. The convex shape is selected according to the wanted explosion cone. The convex shape can be for example a segment or a part of a spheroidal, parabolical or similar double-curvature surface.

The explosive is formed as a layer of even thickness or it is shaped to a lens shape having uneven thickness. The shape and thickness of the explosive layer together with the explosive material parameters, such as velocity of detonation and the position of the detonator at the apex, etc., is designed such that an advancing detonation frontal in the explosive launches the fragmentation material to the intended direction. So basically the munition is design according to the primary target properties, the fragmentation unit size is designed and so is the intended detonation altitude, etc. There are plenty of suitable explosives for the purpose, in tradenames or codes such as C-4, PENO, Semtex, etc.

According to an embodiment the detonator comprises a range detecting device wherein the wanted detection range or altitude can be set. It can also be fully preset, so that the munition is constantly set to detonate for example at 25 meters above the detected target or ground. The range detecting device typically comprises a laser or a radar apparatus for determining the distance between the munition and the target or ground.

According to an embodiment the matrix of fragmentation material comprises metallic, ceramic, plastic materials or combinations thereof. These can be bond together to form a single piece which fragments at the explosion or the fragmentation material can be separately contained but packed on the space inside the munition. An average mass of one fragment unit of the fragmentation material is in the range of 0.0001 kg to 0.200 kg. The design weight of one fragment unit depends on the intended target and its armouring. For no-armoured or very light armouring targets the unit weight may be smaller and for heavier targets for instance in armoured personnel carrier vehicles the unit weight is selected to be heavier. High density and high hardness materials are among preferred materials.

According to an embodiment the body part forms a shell around the explosive and the matrix of the fragmentation material. The body part may be of fiber reinforced plastic, glassfiber coated plastic, metallic material, etc. The main function of the body part is to give the correct shape to the explosive and protect the munition for any deterioration during storage, handling and launching. The body part can also be used in the manufacturing phase as a cast mold for explosive material to be cast to a void space inside or on the body part. One shape relating issue is that advantageously the munitions can be compactly packed next to each other so that there are no space wasted. Thus the construction of the body part is such that multiple munitions are pliable together.

According to an embodiment the munition is comprises aerial guiding means such as a parachute or aerofoils to stabilize the movement of the munition during delivery in the air. The aerial guiding means can be active or passive so that it is activated on certain altitude or for example due to the opening of the carrier, or it is passive so that the fixed aerofoils causes a predetermined angle of attack and possible rotation for stabilizing effect of the munition as a projectile.

The present munition can be delivered inside various means to the target area. Grenades, aerial bombs, rockets and missiles are possible means for delivery. In one embodiment the munition is arranged as a take off canister comprising the munition and a take off charge device for launching the munition up to the air on remote control command or triggered by selected excitation or impulse. In this embodiment the take off charge launches the munition up to the air where possibly the stabilizing parachute opens, stabilizes the flight and then at a predetermined height the munition is detonated and it explodes. This can also operate without the parachute, just launch the munition up with the take off charge device and then detonate the explosive at a proper height and an appropriate time.

Figure 2:
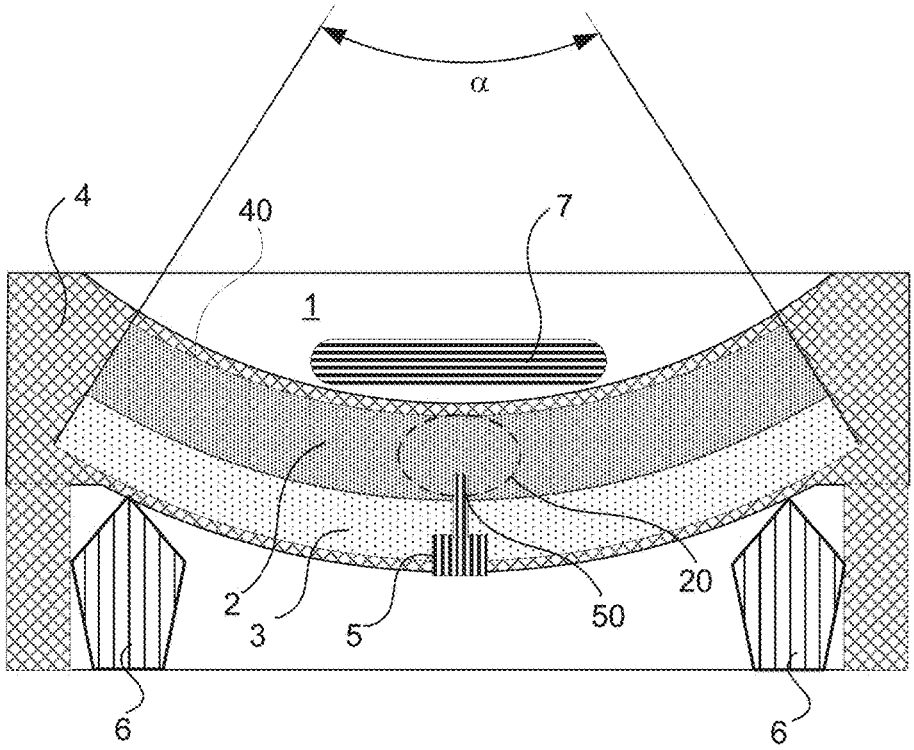
Figure 3A:
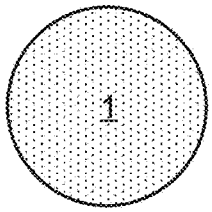
Figure 3B:
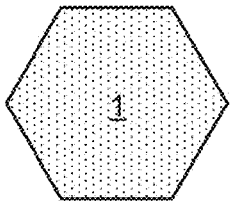
Figure 3C:
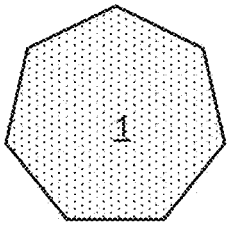
Figure 3D:
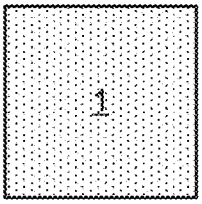
Figure 3E:
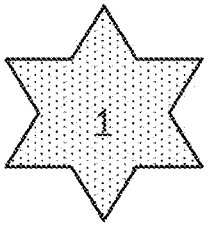
Figure 3F:
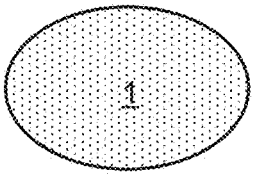
Figure 3G:
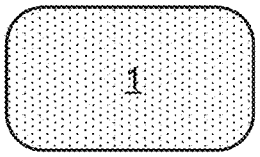
Figure 3H:
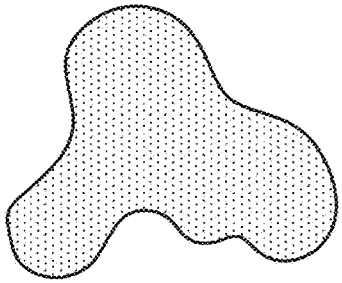
Figure 4:
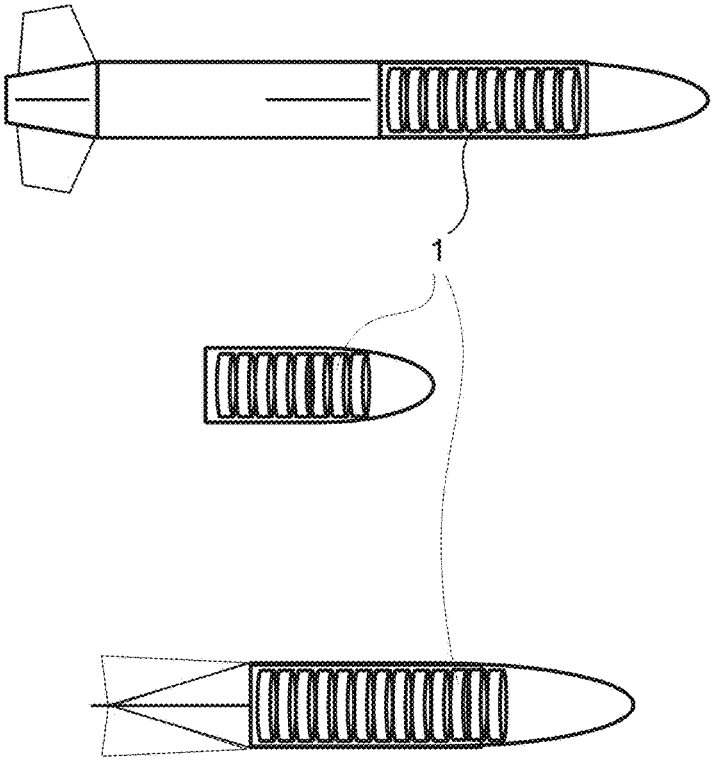
Figure 5:
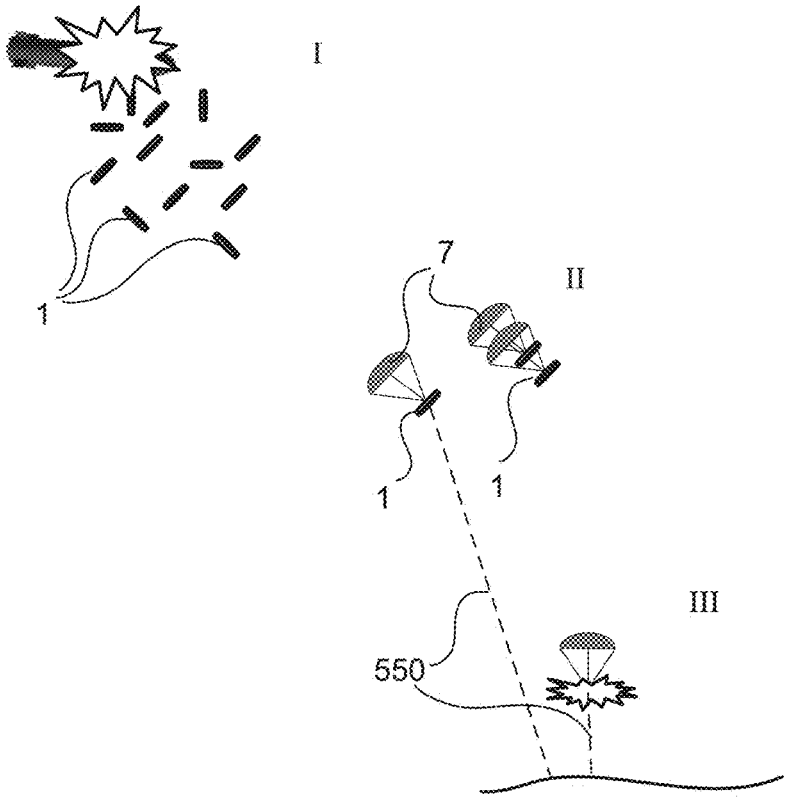
Figure 6:
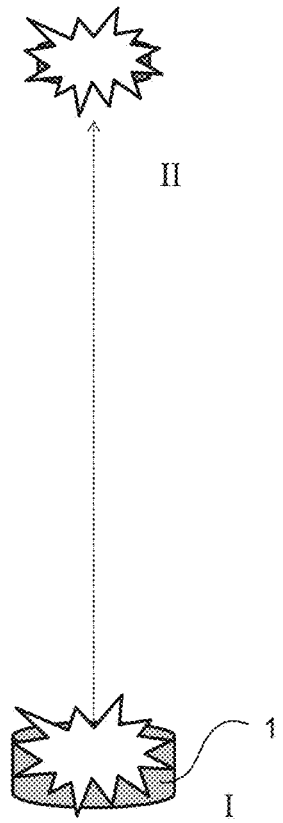
Figure 7:
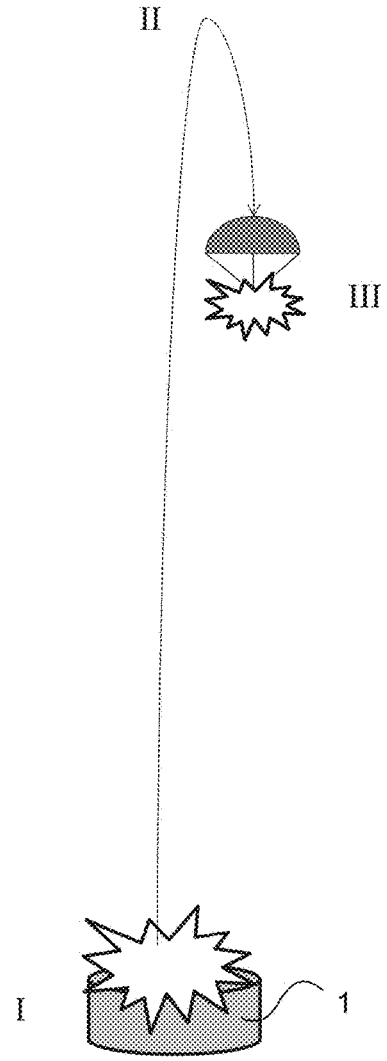
Figure 8:
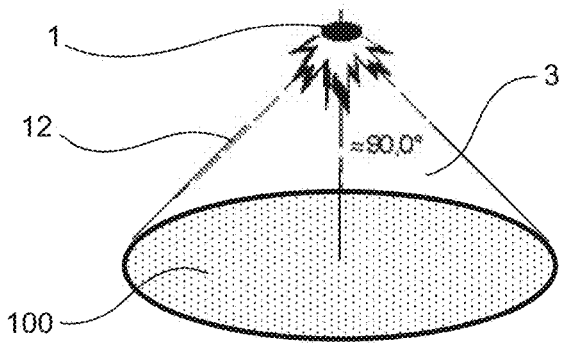

In the following the present invention is explained in more detail in reference to attached drawings wherein FIG. 1 presents a schematical cross section of the munition, FIG. 2 presents a schematical cross section of the take off canister application of the munition, FIG. 3*a*-3*h* presents some of the possible shapes of the munition from below, FIG. 4 presents some of the possible delivery means of the munition, FIG. 5 presents a possible explosion cone of the munition, FIG. 6 presents a take off canister application, FIG. 7 presents an other take off canister application, FIG. 8 presents an illustration of an explosion cone and a distribution pattern.

In FIG. 1 it is presented a munition 1 to be exploded in air at a position above an intended target, the munition 1 comprising:

an explosive 2 comprising an amount of explosive material, a matrix of fragmentation material 3 for causing fragmentation effect to the target, a body part 4 to support and hold the parts of the munition 1 together until detonated, a detonator 5 for detonating the munition 1 at the given time or position, the munition comprises a layered structure so that the body part 4 has a convex shaped support element 40 facing the explosive 2, the explosive is formed to a shape corresponding the convex shape of the body part 4 and the matrix of fragmentation material 3 is arranged in a convex shape corresponding the shape of the explosive 2, the detonator 5 is positioned at the apex 20 of the explosive, wherein the layered structure is designed to cause, when detonated, a directional explosion cone of the fragmentation material 3 in order to form a delimited distribution pattern of the fragmentation material 3 over the target area. The dome angle $\alpha$ determines partly the explosion cone shape. Designing the exact shape of the convex can be done for example with mathematical simulation tools so that the shape and explosive properties are calculated and combined so that the explosion cone is as intended and the distribution of fragmentation material over the target area is even enough.

The body part 3 forms a shell around the explosive and the matrix of the fragmentation material. The body part may be of fiber reinforced plastic, glass-fiber coated plastic, metallic material, etc. thus there are plenty of possibilities for the material. Also one aspect of the body part is that the other devices like the detonator, possible detonation control electronics, flight stabilizing devices i.e. aerial guiding means need to be attached together and the body part is serving also that purpose. However the one of main functions of the body part is to give the correct shape to the explosive and protect the munition for any deterioration during storage, handling and launching. Alternatively an auxiliary part can be used for the purpose of shape determination of the explosive. The body part can also be used in the manufacturing phase as a cast mold for explosive material to be cast to a void space inside or on the body part. One shape relating issue is that advantageously the munitions can be compactly packed next to each other so that there are no space wasted. Thus the construction of the body part is such that multiple munitions are pliable together.

In FIG. 2 it is presented an embodiment comprising a munition similar to FIG. 1 but fitted for a take off canister application. The basic parts are the same as disclosed in connection with FIG. 1 but there are in addition a take off charge device or devices 6, which are configured for launching the munition 1 up to the air on command such as remote control command or triggered by selected excitation or impulse. Basic application is an electrically ignitable gunpowder or corresponding explosive charge which is capable of launch the munition to a wanted height. In FIG. 2 it is also shown an embodiment with an aerial guiding means such as a openable parachute for stabilize the landing phase before the detonation. In FIG. 2 there is shown only one possible alternative of the aerial guiding means as packed, different type of aerofoils can be also be used for the same purpose or it can be without the aerial guiding means, just to launch the munition up and detonate the explosive.

In FIGS. 3*a* to 3*g* it is presented some of the various possible forms of the munition. The shape of the munition can be for example round (FIG. 3*a*), square (FIG. 3*d*), quadrangle (FIG. 3*g*), hexagonal (FIG. 3*b*), heptagon (FIG. 3*c*), star-shaped (FIG. 3*e*), oval (FIG. 3*f*), asymmetric "free form" (FIG. 3 *h*), parallelogram or corresponding shape in a plane direction In FIG. 4 it is presented schematically some of the various means for delivering the present munition 1. The present munition 1 can be a payload of canister munition of, for example, rockets and missiles, grenades or aerial bombs. Thus as an embodiment of delivering comprises plurality of said munition. In an artillery grenade there may be 10 to 15 pieces of 2 kg munition inside, but in a large aerial bomb there may be even a couple of hundred pieces of smaller munition inside or for example 20 pieces of 20 kg munitions.

In FIG. 5 it is presented an embodiment of the operation with the present munition. In phase I the delivery means such as an artillery rocket opens up at a location above the intended target and diffuses the munition around. There are suitable technology readily available to perform this ejection or spreading around phase I. In the following phase II an aerial guiding means 7 such as parachute is activated or opens and stabilizes the flight of now separately to each other falling munitions. Especially the aerial guiding means corrects and stabilizes the attack of angle of the munition so that the munition is in correct orientation, fragmentation material towards the target. A range detecting device or corresponding trigger has been activated and it measures the distance to the target or ground by for example with a laser beam 550. On phase III, at the preset height, for example on command of a laser range detecting device or of a radar type, when the beam 550 length reaches the trigger limit and then the munition is detonated and it explodes.

In FIGS. 6 and 7 it is presented a take off canister application function in principle. In FIG. 6 an electrically ignitable gunpowder or corresponding explosive charge launches (phase I) the munition to a wanted height (phase II) where it explodes. This can be caused for example by a delay detonator or corresponding. In FIG. 7 it is also shown an embodiment with an aerial guiding means such as a openable parachute for stabilize the landing phase before the detonation.

In FIG. 8 it is presented an illustration of the exploding munition 1 causing the fragmentation material 3 to fly mostly inside an explosion cone 12 and then hitting the ground or other target area and creating a delimited distribution pattern 100 of the fragmentation material. It is optimal when single fragments are spread evenly on the intended area and creating the delimited distribution pattern 100. In FIG. 8 it is presented an embodiment wherein the explosion cone angle is approximately 90 degrees. Thus the possible pieces flying to other directions are lost from participating the actual task of the munition, to destroy the target at the specific area below the exploded munition 1.

As evident to those skilled in the art, the invention and its embodiments are not limited to the above-described embodiment examples. Expressions representing the existence of characteristics, such as "the munition comprises an explosive comprising an amount of explosive material", are non-restrictive such that the description of characteristics does not exclude or prerequisite the existence of such other characteristics which are not presented in the independent or dependent claims.

REFERENCE SIGNS USED IN THE FIGURES

1 munition
12 explosion cone
100 distribution pattern of fragmentation material
2 explosive
20 apex of the explosive
3 fragmentation material
4 body part
40 support element
5 detonator
55 range detecting device
550 beam of range detecting device
6 take off charge device
7 aerial guiding means
α dome angle

The invention claimed is:

1. A munition configured for being exploded in air at a position above an intended target, the munition comprising the layered structure of:

a body part to support and hold parts of the munition together before being detonated, said body part having a convex dome-like shaped support element facing an explosive;

the explosive having an amount of explosive material and having a shape corresponding to the convex dome-like shaped support element of the body part;

a matrix of fragmentation material located between the explosive and the body part, for causing a fragmentation effect to a target, said matrix of fragmentation material arranged in a convex dome-like shape corresponding to the shape of the explosive;

a detonator for detonating the munition at a given time or position, said detonator positioned at an apex of the explosive and an aerial guiding means for stabilizing moving of the munition during delivery in the air;

wherein the layered structure including the body part, the explosive, the matrix of fragmentation material, and the detonator is configured to, when detonated, causing a directional explosion cone of the fragmentation material to form a delimited distribution pattern of the fragmentation material over a target area, and wherein the munition is configured for being arranged in a takeoff canister with a take off charge device for launching the munition up to the air where at a predetermined height the munition is configured to being detonated and the munition exploding.

2. The munition according to claim 1, wherein the munition has a round, square, quadrangle, hexagonal, parallelogram or star shape in a plane direction, and the convex dome-like shape is in a direction perpendicular to the plane.

3. The munition according to claim 1, wherein the explosive is a layer with an even thickness or it is shaped to a lens shape having an uneven thickness.

4. The munition according to claim 2, wherein the shape and a thickness of the explosive material, together with parameters of the explosive material, is configured to, when detonated, an advancing detonation frontal in the explosive launching the fragmentation material to an intended direction.

5. The munition according to claim 1, wherein the detonator includes a range detecting device, and wherein a wanted detection range or altitude can be set.

6. The munition according to claim 5, wherein the range detecting device includes a laser or radar apparatus for determining a distance between the munition and a target or ground.

7. The munition according to claim 1, wherein the matrix of fragmentation material includes one or more of metallic, ceramic and plastic materials or.

8. The munition according to claim 1, wherein an average mass of one fragment unit of the fragmentation material is between 0.0001 kg and 0.200 kg.

9. The munition according to claim 1, wherein the body part forms a shell around the explosive and the matrix of the fragmentation material.

10. The munition according to claim 1, wherein a construction of the body part is such that multiple munitions are pliable together.

11. A takeoff canister comprising;

a munition configured for being exploded in air at a position above an intended target and a takeoff charge device configured to launching the munition into the air, wherein the munition includes the layered structure of:

a body part to support and hold parts of the munition together before being detonated, said body part having a convex dome-like shaped support element facing an explosive^ the explosive having an amount of explosive material and having a shape corresponding to the convex dome-like shaped support element of the body part;

a matrix of fragmentation material located between the explosive and the body part, for causing a fragmentation effect to a target, said matrix of fragmentation material arranged in a convex dome-like shape corresponding to the shape of the explosive;

a detonator for detonating the munition at a given time or position, said detonator positioned at an apex of the explosive; and an aerial guiding means for stabilizing moving of the munition during delivery in the air;

wherein the layered structure including the body part, the explosive, the matrix of fragmentation material, and the detonator is configured for, when detonated, causing a directional explosion cone of the fragmentation material to form a delimited distribution pattern of the fragmentation material over a target area.

* * * * *